US005361455A

United States Patent [19]

Kiefer

[11] Patent Number: 5,361,455

[45] Date of Patent: Nov. 8, 1994

[54] HINGE

[75] Inventor: James Kiefer, Grand Rapids, Mich.

[73] Assignee: RAN Enterprises, Inc., Grand Rapids, Mich.

[21] Appl. No.: 997,906

[22] Filed: Dec. 29, 1992

[51] Int. Cl.[5] ..... E05D 5/08; E05D 7/10; E05D 7/04

[52] U.S. Cl. ..... 16/235; 16/272; 16/374; 16/387

[58] Field of Search ..... 16/249, 252, 271, 272, 16/235, 237, 236, 374, 376, 377, 387, 364

[56] References Cited

U.S. PATENT DOCUMENTS

| | | | |
|---|---|---|---|
| 546,909 | 9/1895 | Spencer | 16/271 |
| 617,043 | 1/1899 | Phifer | 16/271 |
| 888,049 | 5/1908 | Squires et al. | 16/252 |
| 1,092,236 | 4/1914 | Wrikeman | 16/271 |
| 1,228,481 | 6/1917 | Saino | 16/237 |
| 1,360,284 | 11/1920 | Gagnon | 16/249 |
| 1,469,525 | 10/1923 | Nadolney | 16/271 |
| 1,481,142 | 1/1924 | Minton et al. | 16/271 |
| 1,569,619 | 1/1926 | Cranzler | 16/376 |
| 2,027,888 | 1/1936 | Solomon | 16/249 |
| 2,211,581 | 8/1940 | Ross | 16/387 |
| 4,305,614 | 12/1981 | Holka et al. | 296/37.16 |
| 4,407,044 | 10/1983 | Iseki | 16/237 |
| 4,532,675 | 8/1985 | Salazar | 16/374 |
| 5,038,436 | 8/1991 | Ihrke | 16/249 |
| 5,067,201 | 11/1991 | Marchione | 16/271 |
| 5,095,582 | 3/1992 | Ohlsson | 16/235 |

FOREIGN PATENT DOCUMENTS

| | | | |
|---|---|---|---|
| 2620759 | 3/1989 | France | 16/271 |
| 2644505 | 9/1991 | France | 16/249 |
| 286632 | 8/1915 | Germany | 16/237 |
| 398963 | 9/1933 | United Kingdom | 16/271 |
| 502209 | 3/1939 | United Kingdom | 16/249 |
| 1431673 | 4/1973 | United Kingdom | 16/376 |

*Primary Examiner*—Lowell A. Larson
*Assistant Examiner*—Donald M. Gurley
*Attorney, Agent, or Firm*—Price, Heneveld, Cooper, DeWitt & Litton

[57] ABSTRACT

A hinge for a vehicle includes a stationary sheet metal hinge base adapted to attach to a vehicle, a sheet metal panel bracket adapted to attach to a vehicle panel, and a sheet metal hinge member operably connecting the hinge base and panel bracket. The panel bracket is slideably attached to the hinge member and movable between an extended position and a retracted final assembly position. The hinge member is also pivotally connected to the hinge base and rotatably movable through an arcuate path including a panel open position, a panel closed position and at least one intermediate position therebetween. The hinge member, when the panel bracket is in the extended position, is movable to the intermediate position in the arcuate path so that the panel is spaced from the vehicle to facilitate painting of the panel and the vehicle. The hinge member, when the panel bracket is in the retracted position, is movable to locate the panel relative to the vehicle in a final assembly position. Thus, the panel can be readily extended to facilitate painting and can be retracted for final panel fit during vehicle assembly without removing the panel from the vehicle.

25 Claims, 11 Drawing Sheets

HINGE

BACKGROUND OF THE INVENTION

The present invention concerns hinges, and in particular a vehicle hinge facilitating painting and assembly of the vehicle.

It is particularly advantageous to paint vehicle body panels simultaneously with the vehicle during assembly since this reduces or eliminates color mismatches and also provides assembly plant advantages such as reduced paint waste and labor. However, in modern vehicles, the body panels are positioned close to each other for improved appearance, reduced wind resistance and noise, and the like. Hence, some vehicle body panels are not positioned on the vehicle with enough clearance around the body panel edges to allow adequate painting of the body panel edges and the adjacent area on the vehicle. For example, in a sedan or minivan, the vehicle rear gate or trunk lid includes an edge adjacent the rear window lower sheet metal of the vehicle body, which edge and window lower sheet metal cannot be adequately painted if the rear gate is closed, but which edge shadows the rear window lower sheet metal if the rear gate is opened. Hence, present vehicle assembly techniques either include removing the rear gate lid, or include a special painting operation where the rear gate is painted in a first position and then painted again along the problem edge area with the rear gate held in a second position.

Thus, a hinge is desired to facilitate improved painting and assembly of a vehicle.

SUMMARY OF THE INVENTION

The present invention includes a hinge having a stationary hinge base adapted to attach to a vehicle, a panel bracket adapted to attach to a vehicle panel, and a hinge member operably connected therebetween. In particular, the panel bracket is slideably attached to the hinge member and movable between an extended position to facilitate painting and a retracted final assembly position. The hinge member is also pivotally connected to the hinge base and is rotatably movable through an arcuate path including a panel open position, a panel closed position and at least one intermediate position therebetween. The hinge member, when in said extended position, is movable to the intermediate position in the arcuate path so that the panel is spaced from the vehicle to facilitate painting of the panel and the vehicle. Also, the hinge member, when in said retracted position, locates the panel relative to the vehicle as desired in a final assembly position with an aesthetically close fit between the body panel and the vehicle. The hinge further includes means for securing said hinge member to the panel bracket in the extended position or in the retracted position, thus allowing the panel to be readily extended to facilitate painting and to be retracted for final panel fit during vehicle assembly without removing the panel from the vehicle.

The preferred embodiments of the present invention includes several advantages over known art. The preferred embodiments include a hinge for a vehicle body panel that extends providing increased clearance between the body panel and the vehicle, thus eliminating the need to remove the body panel for separate painting and also eliminating the alternative method commonly used which is to provide a secondary, special, manual painting step. Thus, the area can be automatically painted on-line with the remainder of the vehicle. Also, the hinges provide a controlled extension so that the body panel is not dropped or damaged when extended, and further the hinges limit telescoping retraction of the hinges so that the hinges can be retracted to a predetermined final retracted position, hence improving the final body panel location relative to the vehicle without requiring excessive refitting of the body panel. The hinge also includes abutting tabs limiting the rotation of the body panel in the open position and preventing over-travel. Still further, the major hinge components are made from sheet metal to minimize weight and cost.

One of the embodiments includes components forming a two-piece non-telescoping hinge, but which can be readily reworked to form a three-piece telescoping hinge even after manufacture of the two-piece hinge components. Further, the hinge components of this one embodiment do not require any welding, thus making their manufacture more cost effective.

These and other features, advantages, and objects of the present invention will be further understood and appreciated by those skilled in the art by reference to the following specification, claims and appended drawings.

DETAILED DESCRIPTION OF THE PREFERRED EMBODIMENT

Figure 14:
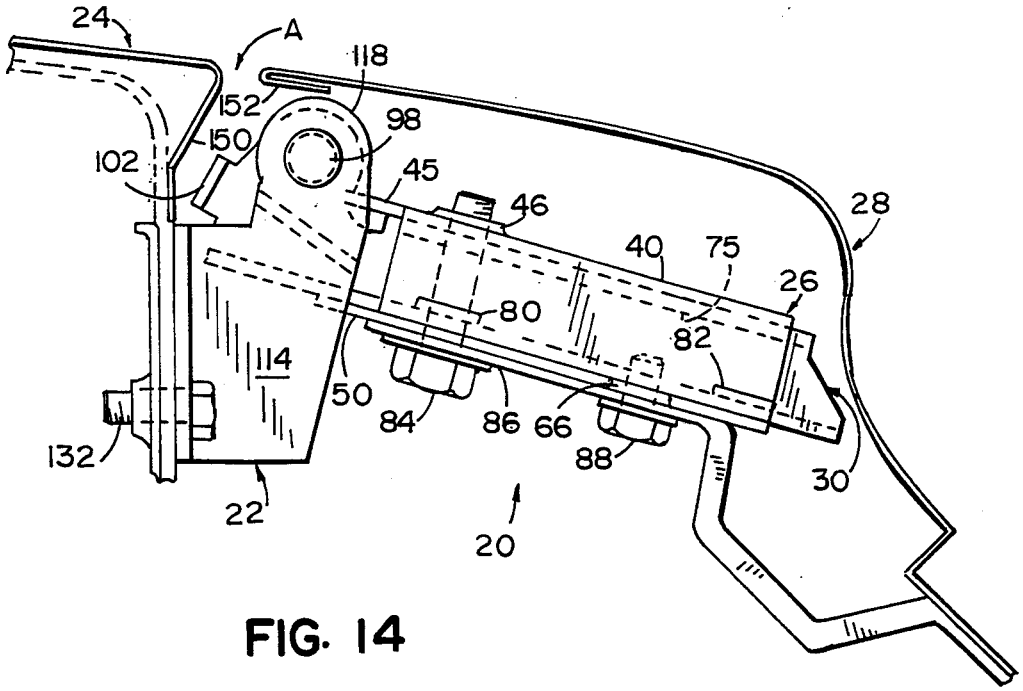
FIG. 14 is a side view of the hinge assembly in a retracted position with the vehicle rear gate attached, the hinge assembly also being shown in a closed position.
Figure 16:
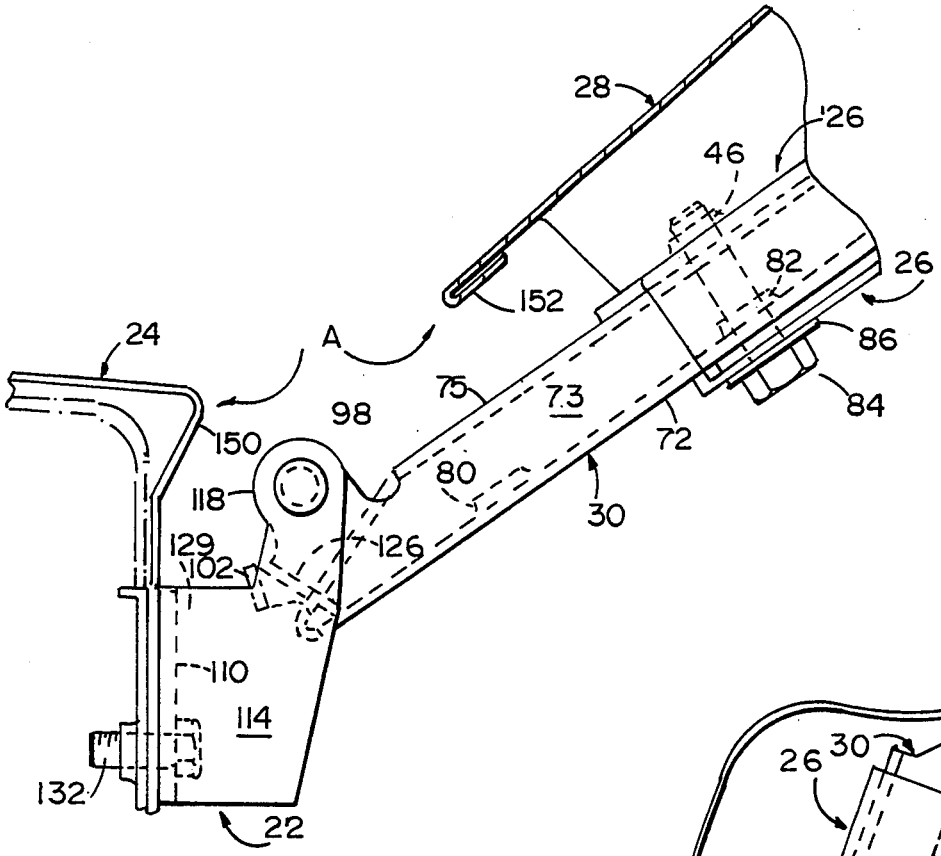
FIG. 16 is a side view of the hinge assembly in the extended position with the vehicle rear gate attached, the hinge assembly also being shown in an intermediate manufacture/painting facilitating position.
Figure 15:
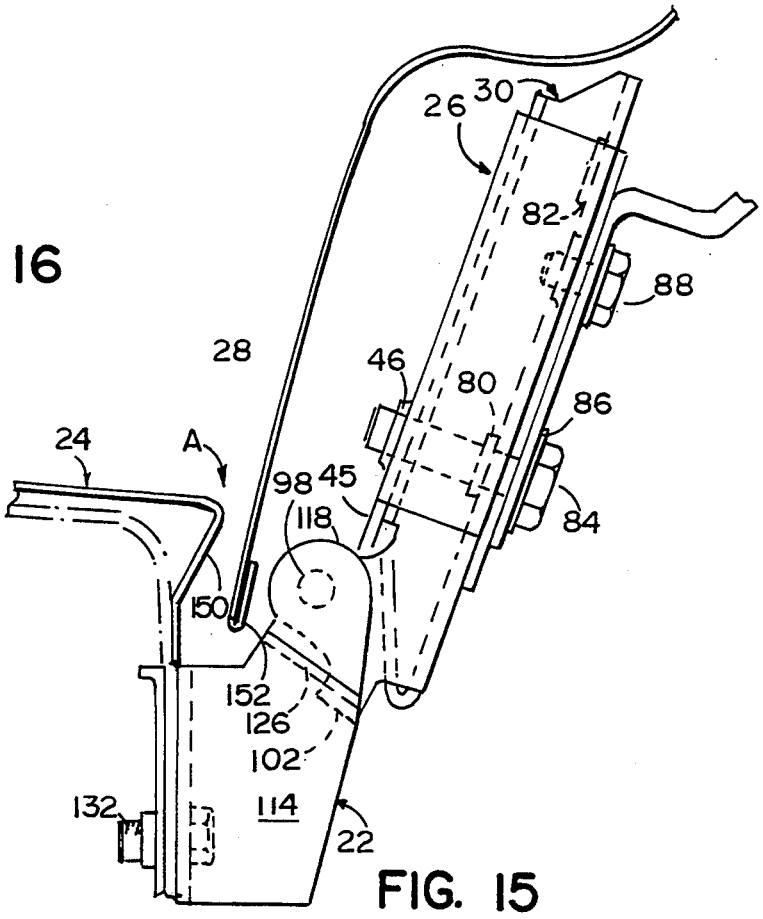
FIG. 15 is a side view of the hinge assembly in a retracted position with the vehicle rear gate attached, the hinge assembly also being shown in a fully open position.

A hinge 20 (FIGS. 1 and 14) embodying the present invention includes a hinge base 22 adapted to attach to a vehicle 24, a panel bracket 26 adapted to attach to a vehicle body panel such as a rear gate or trunk lid 28, and a hinge member 30 pivotally connected to the hinge base 22 and slideably connected to the panel bracket 26. Hinge 20 is extendable so that body panel 28 can be moved to provide clearance between vehicle 24 and body panel 28 to facilitate simultaneously painting the vehicle 24, the body panel 28, and in particular the area "A" therebetween, without removing body panel 28 from vehicle 24. As can be seen in FIGS. 14 and 15, area "A", and in particular surfaces 150 and 152, are inaccessible and "shadowed" so that adequate paint coverage is a problem when body panel 28 is positioned in a final assembly position. However, area "A" can be made accessible by use of the present hinge 20, as noted below and generally shown in FIG. 16.

Figure 5:
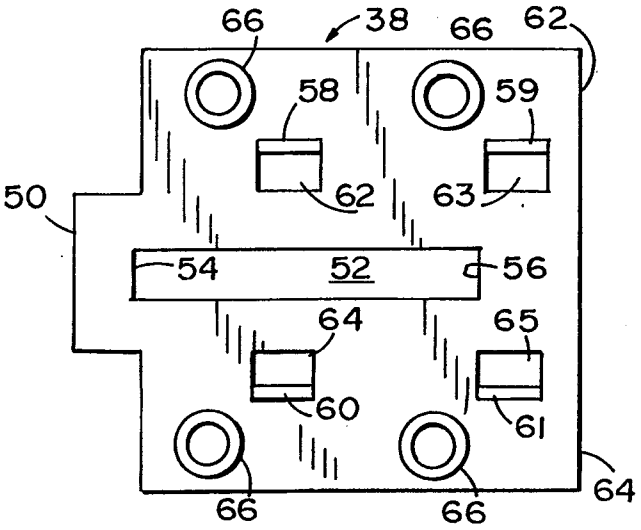
FIGS. 5–6 are orthogonal views of a second half of a panel bracket.
Figure 6:
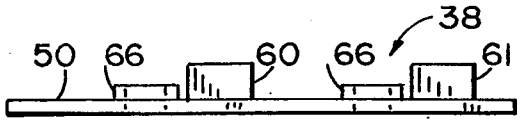
Figure 4:
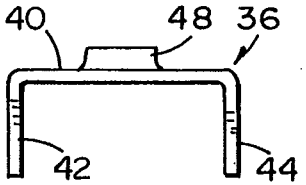
FIGS. 2–4 are orthogonal views of a first half of a panel bracket.
Figure 2:
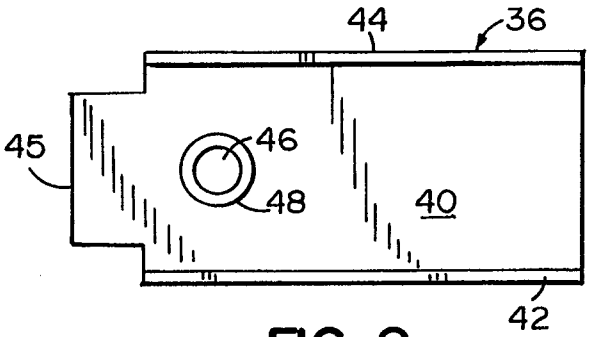
Figure 3:
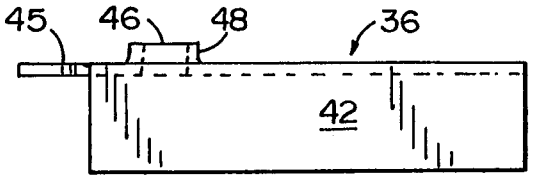

More particularly, panel bracket 26 (FIG. 1) is a welded assembly made from a first half 36 (FIGS. 2–4) and a second half 38 (FIGS. 5–6). First half 36 (FIGS. 2–4) is an elongate sheet metal part having a C-shaped cross section including a planar middle section 40 and side flanges 42 and 44. A tongue 45 extends from middle section 40 forward of side flanges 42 and 44. A hole 46 is centrally located in middle section 40 near tongue 46, hole 46 being defined in part by an extruded lip 48 that protrudes from middle section 40 in a direction opposite side flanges 42 and 44.

Second half 38 (FIGS. 5–6) is a planar sheet metal part that is generally rectangular in shape. Second half 38 has a length that generally corresponds to the-length of first half 36, and includes a tongue 50 which corresponds to tongue 45 of first half 38. A slot 52 is defined longitudinally in second half 38 and includes a first end 54 and a second end 56. Four tabs 58, 59, 60 and 61 are bent upwardly perpendicularly to the planar body of second half 38. Tabs 58–61 are spaced apart in a rectangular pattern to closely receive therebetween side flanges 42 and 44 of first half 36, tabs 58–61 locating first half 36 on second half 38 from side-to-side. Notably, side flanges 42 and 44 could also locate fore-to-aft on tabs 58–61 or on holes 62–65 formed adjacent tabs 58–61, though this is not presently contemplated as being necessary. Second half 38 includes flange portions 62 and 64 that extend outwardly beyond tabs 58–61. These flange portions 62 and 64 include extruded attachment holes 66, holes 66 being useful to secure second half 38 to body panel 28 by use of screws 88.

First and second halves 36 and 38 are welded together to form panel bracket 26 (FIG. 1) such that tongues 45, 50 are in registry and aligned with one another. Bracket 26 has a tubular sleeve-like shape defining an elongate sleeve-like pocket 68 having a rectangular cross-sectional shape, the rectangular shape being preferable over a round cross-sectional shape to control rotation in pocket 68. Pocket 68 is particularly adapted to slideably telescopingly receive hinge member 30, as described below. Notably, hole 46 is located above slot 52 near slot end 54 in the welded arrangement of panel bracket 26.

Figure 1:
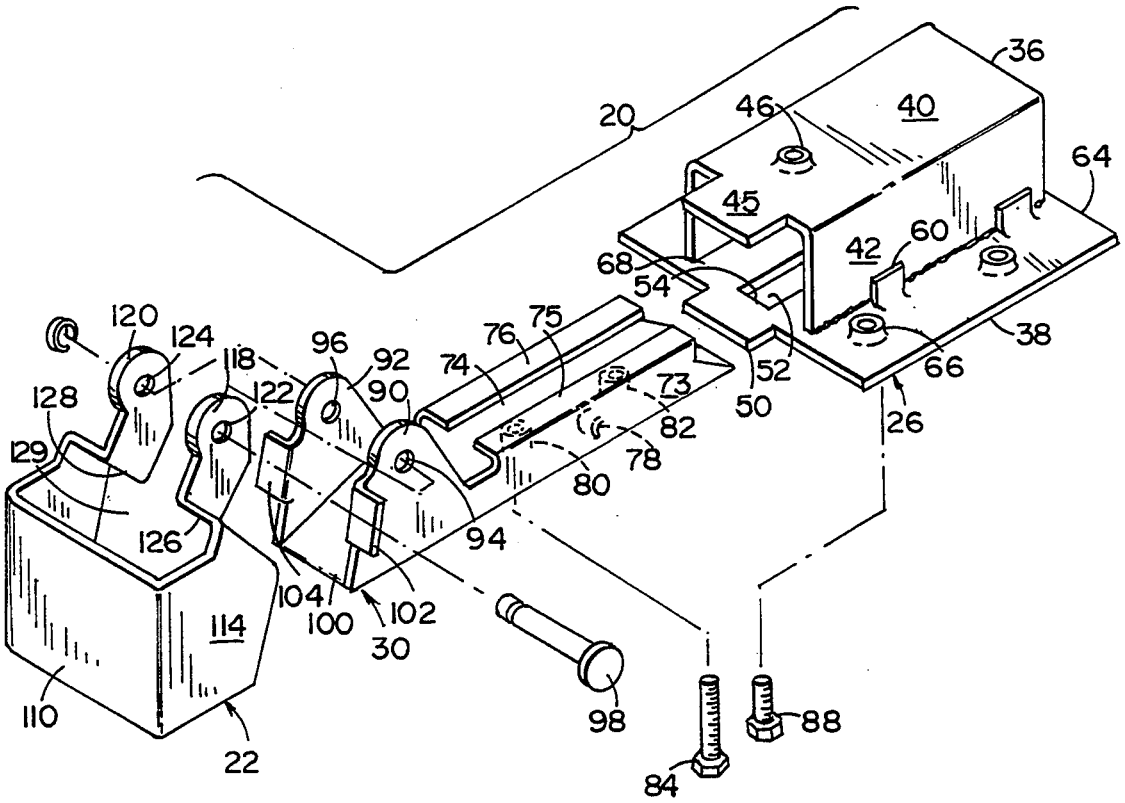
FIG. 1 is an exploded perspective view of a hinge assembly embodying the present invention.
Figure 13:
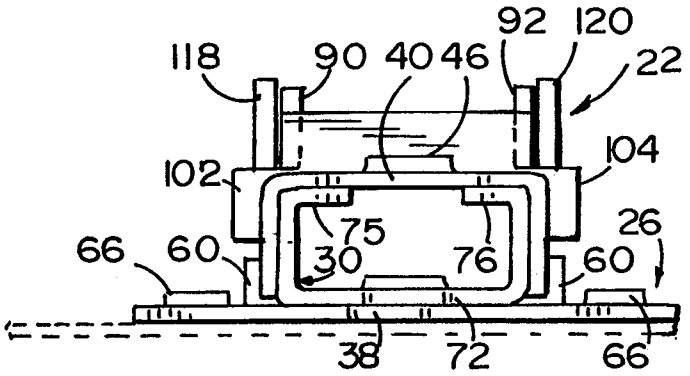
FIG. 13 is an end view of the hinge assembly including the panel bracket, the movable hinge member and the hinge base.
Figure 9:
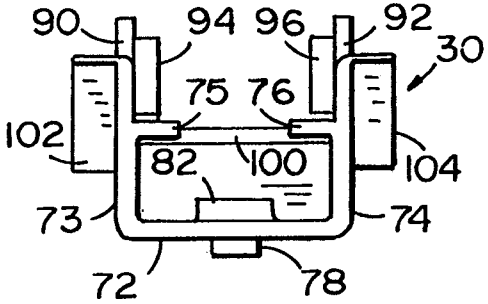
FIGS. 7–9 are orthogonal views of a movable hinge member.
Figure 7:
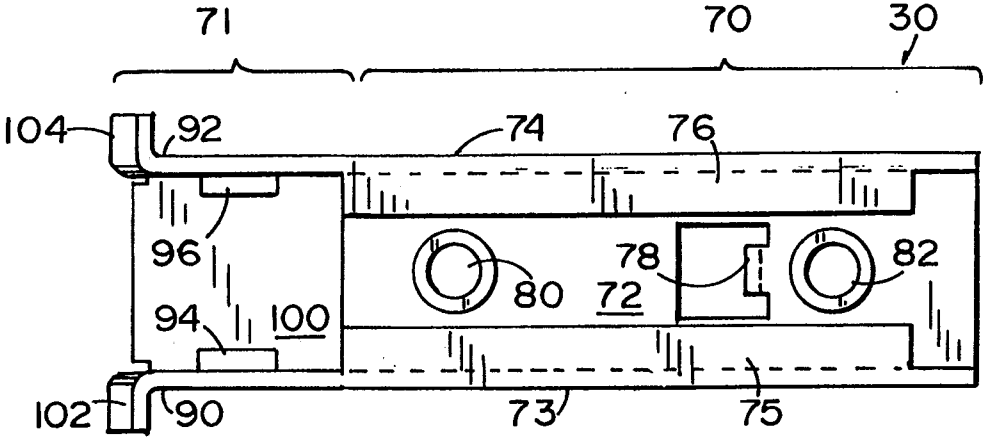
Figure 8:
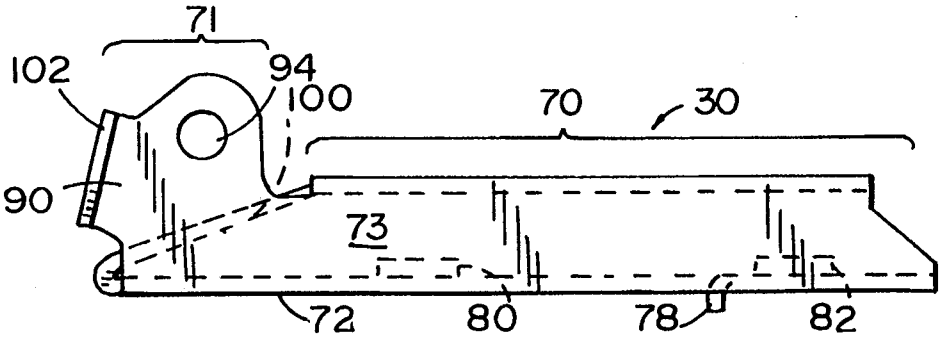

Hinge member 30 (FIGS. 7–9) is formed from sheet metal and includes an elongated arm 70 and a pivot pin receiving end 71. Arm 70 has a C-shaped cross-section (FIG. 9) defined by lower wall 72, side walls 73 and 74, and upper wall sections 75 and 76. Arm 70 is shaped so that walls 72–76 closely slideably fit within pocket 68 of panel bracket 26 (FIGS. 1 and 13). A tab 78 extends downwardly from lower wall 72 (FIG. 8), tab 78 being optimally located to engage slot ends 54 and 56 in second half 38 to limit the stroke of hinge member 30 as hinge member 30 slideably moves in pocket 68 of panel bracket 26. Notably, it is contemplated that tab 78 could be replaced by a screw or other limiting means, or that a rectangular solid bar could be substituted for all of arm 70, however the present arrangement is believed preferable since it offers the advantages of reduced weight, reduced cost, reduced number of parts, and reduced complexity. A pair of spaced extruded holes 80 and 82 extend inwardly from lower wall 72 of arm 70 toward the center of arm 70.

A self-tapping screw 84 (FIGS. 15 and 16) is insertable through slot 52 and into hole 80 or 82. With hinge member 30 in an extended position (FIG. 16) screw 84 can be extended through slot 52 and into hole 82 and hole 46, where screw 84 can be tightened to clampingly securely hold hinge member 30 in the extended position. Screw 84 includes a washer-like flange 86 on the screw head adapted to clampingly engage and hold panel bracket 26 to hinge member wall 72. Alternatively, with hinge member 30 in a retracted position (FIGS. 14 and 15), screw 84 can be extended through slot 52 and into hole 80 and hole 46, where it can be tightened to securely hold hinge member 30 in the retracted position.

Pivot pin receiving end 71 of hinge member 30 (FIGS. 7–9) includes parallel upright flanges 90 and 92 that align with side walls 73 and 74, flanges 90 and 92 including aligned holes 94 and 96 for receiving pivot pin 98 (FIG. 1). Optimally, holes 94 and 96 are extruded inwardly to provide increased strength and bearing surface for receiving pivot pin 98. Wall 72 extends forward of arm 70 between flanges 90 and 92, and includes a tongue 100 that is bent backwardly at an angle to wall 72. Tongue 100 abuts the inside of flanges 90 and 92 and supportingly maintains the parallel spacing of the flanges. Two tabs 102 and 104 are located at the outer longitudinal edges of flanges 90 and 92, and extend laterally outwardly.

Figure 12:
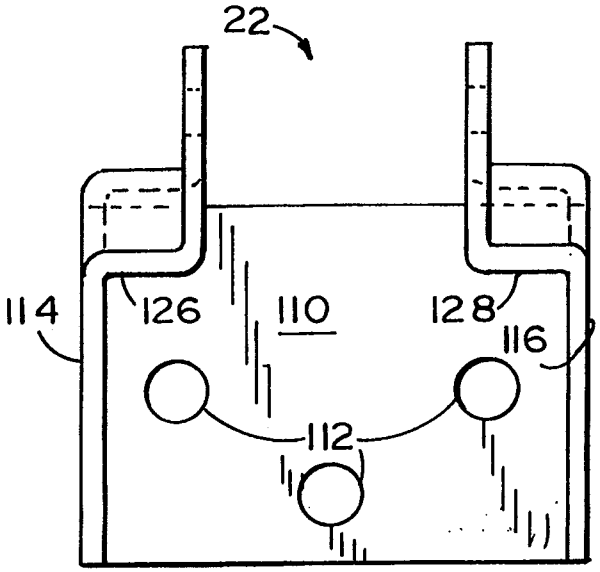
FIGS. 10–12 are orthogonal views of a hinge base, FIG. 11 being a fragmentary view.
Figure 11:
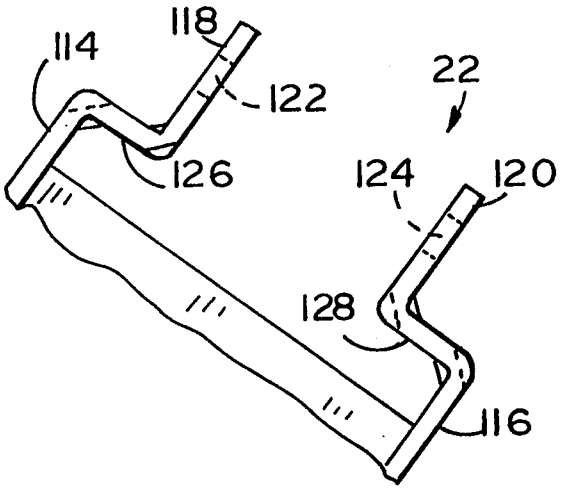
Figure 10:
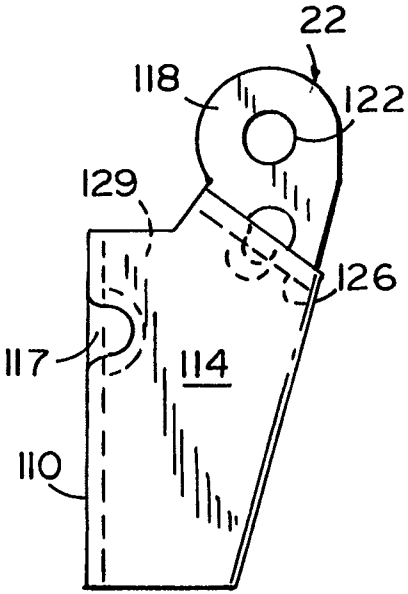

Hinge base 22 (FIGS. 10–12) includes a mounting wall 110 with mounting holes 112 for attaching hinge base 22 to the vehicle 24. Hinge base 22 also includes spaced side flanges 114 and 116 that extend normally to mounting wall 110, gussets 117 being provided at the intersection of walls 110, 114 and 116 for increased stability of flanges 114 and 116. A pair of spaced parallel tabs 118 and 120 extend from flanges 114 and 116 and are supported by side flange offset sections 126 and 128. Tabs 118 and 120 are spaced apart a predetermined distance to closely receive flanges 90 and 92 of hinge member 30 (FIG. 13). Offset tabs 118 and 120 include holes 122 and 124 that align with holes 94 and 96 of hinge member flanges 90 and 92, so as to receive pivot pin 98 (FIG. 1). Gussets similar to gussets 117 are added as needed to stabilize tabs 118 and 120, and offset sections 126 and 128.

With hinge member 30 pivotally attached to hinge base 22, hinge member tab 102 fits between the space 129 (FIGS. 10 and 16) defined by tab-like offset section 126 and base mounting wall 110 as hinge member 30 is pivoted from a closed position to an open position, tab 102 abuttingly engaging tab-like offset section 126 as hinge member 30 reaches the fully open position (FIG. 15). Thus, tab-like section 126 acts as a stop for limiting the rotational movement of hinge member 30 on hinge base 30. Likewise, tab 104 (FIG. 1) simultaneously moves between tab-like offset section 128 and base mounting wall 110 to abuttingly engage tab-like offset section 128 at the fully open position of hinge member 30, sections 126 and 128 acting together to limit hinge 20 and body panel 28 to a maximum fully open position.

OPERATION

Having described the hinge components and interrelationship of hinge components, the uses and advantages of the present invention will become apparent to one of ordinary skill in the art. Hinge panel bracket halves 36 and 38 are initially welded together (FIG. 1) to form panel bracket 26 with hinge member 30 being located in pocket 68 defined in panel bracket 26. As thus formed, hinge member 30 is telescopingly slideable in panel bracket 26 with hinge member tab 78 engaging the ends of slot 52 in panel bracket 26 to limit the travel of hinge member 30 in panel bracket 26.

Panel bracket 26 is then securely attached to the body panel such as rear gate 28 in a predetermined location by screws 88, and the hinge base 22 is also securely attached to the vehicle in a predetermined location such as by screws 132. Hinge member 30 is then pivotally connected to hinge base 22 by pivot pin 98. If net mounting holes or alignment fixtures are used on vehicle 24 and body panel 28, hinge 20 can be installed in the extended position without a need to separately align body panel 28 to vehicle 24 since the net mounting holes provide the necessary alignment.

Hinge 20 is extendable by sliding panel bracket 26 outwardly on hinge member 30 (FIG. 16), the extending movement being limited by tab 78 in slot 52. Hinge member 30 is secured in the extended position by use of screw 84, screw 84 being inserted through slot 52 and holes 82 and 46. By positioning hinge member 30 in an intermediate position between the open and closed positions (FIG. 16), body panel 28 is spaced from vehicle 24 to provide clearance for painting area "A", and in particular around the facing surfaces 150 and 152 of body panel 28 and vehicle 24. Thus, area "A" can be painted without removing body panel 28 from vehicle 24 and without requiring manual painting or special manipulation of body panel 28 on vehicle 24.

After painting, screw 84 is removed, and hinge member 30 is slideably moved to the retracted position (FIGS. 14 and 15) where screw 84 is reinstalled through slot 52, and holes 80 and 46. Optimally, body panel 28 has already been aligned on vehicle 24, and realignment is not necessary. It is contemplated that a washer (not shown) could be placed on screw 84 before tightening, the washer being useful to cover any exposed unpainted areas to prevent any corrosion around the screw head. With hinge member 30 thus secured, panel 28 and hinge member 30 can be rotated between the full open position (FIG. 15) and full closed position (FIG. 14) while maintaining acceptably tight clearances between body panel 28 and vehicle 24.

SECOND EMBODIMENT

Figure 18:
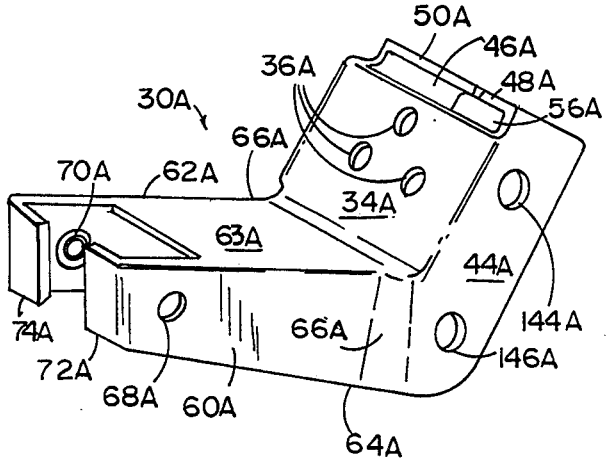
FIG. 18 is a perspective view of a hinge member for the second hinge assembly, the hinge member being adapted for use in a two-piece non-telescoping hinge arrangement.

A second hinge 20A (FIGS. 20 and 21) embodying the present invention includes a hinge base 22A adapted to attach to a vehicle 24A, a panel bracket 26A adapted to attach to a vehicle body panel such as a rear gate 28A, and a hinge member 30A' pivotally connected to the hinge base 22A and slideably connected to the panel bracket 26A. Alternately, hinge 20A may be a two-piece, non-extendable assembly using hinge member 30A (FIG. 18). In its extendable form using hinge member 30A' and panel bracket 36A, hinge 20A is similar to hinge 20 insofar as hinge 20A is extendable so that body panel 28A can be moved to provide clearance between vehicle 24A and body panel 28A to facilitate simultaneous painting of both parts with clearance therebetween to eliminate "shadowing" which causes incomplete paint coverage. However, hinge 20A also provides: 1) the advantage of attaching the body panel 28A in a different manner than hinge 20 to reduce potential intrusion of water into body panel 28A, 2) the advantage of a redesigned hinge base 22A having reduced weight and increased strength due to use of a "camelback" bend, and 3) the advantage of a hinge member 30A that can be used in a two-piece hinge arrangement or is reworkable to form hinge member 30A' so that it can be used in a three-piece telescoping hinge arrangement. Further, hinge 20A includes components made completely by stamping which components do not require welding and thus offer manufacturing advantages due to reduced secondary operations.

More particularly, hinge member 30A (FIG. 18) is a part stamped from a single sheet of metal. Hinge member 30A includes an attachment portion formed by planar section 34A with holes 36A therein for attaching hinge member 30A directly to body panel 28A. Notably, body panel 28A (FIG. 20) is made from an outer panel having an edge 152A and an inner reinforcement panel 155A, and planar section 34A bolts to the exposed surface 157A on the vehicle interior side of body reinforcement panel 40A. Thus, unlike hinge 20 in which panel bracket 26 mounts between the inner and outer panels forming body panel 28 (see FIGS. 14–16), hinge member 30A bolts to the exposed side of body panel 28 so as to reduce the tendency to communicate moisture into the inside of body panel 28A. Further, inner reinforcement panel 155A can be closed against outer panel 152A, thus providing an arrangement which is more easily sealed.

Hinge member 30A (FIG. 18) further includes spaced flanges 44A and 46A that extend perpendicularly from opposing sides of planar section 34A in a U-shaped arrangement, flanges 44A and 46A stabilizing planar section 34A. Further, opposing tab-like stops 48A and 50A are located on one end of flanges 44A and 46A proximate one side of planar section 34A. The upper edges 52A and 54A are spaced below planar section 34A and define a gap 56A therebetween.

A pair of spaced apart arms 60A and 62A and interconnecting planar section 63A extend from flanges 44A and 46A and planar section 34A from an end opposite stops 48A and 50A. Arms 60A and 62A extend parallel each other and include a pair of corresponding bends 64A and 66A near their bottom to reduce the spacing between their length. Near the ends of arms 60A and 62A are inwardly extruded holes 68A and 70A useful for receiving a pivot pin (not shown). Holes 68A and 70A are extruded for increased strength and to provide an enlarged surface area for increased service life. On the ends of arms 60A and 62A are inwardly extending flanges 72A and 74A useful for acting as a stop on hinge base 22A. Members 334A, 44A, 46A, 60A, 62A and 63A form a "camelback" bend having increased strength, as discussed below.

Figure 17:
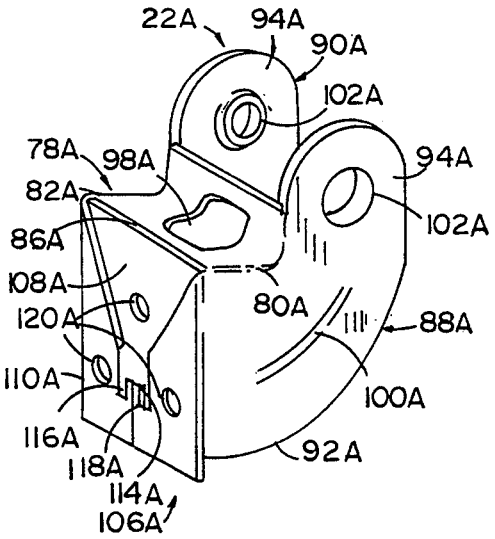
FIG. 17 is a perspective view of a hinge base for a second hinge assembly embodying the present invention.

Hinge base 22A (FIG. 17) includes a shaped center web 78A with opposite side edges 80A and 82A, outer edge 84A and inner edge 86A. A pair of spaced apart L-shaped webs 8A and 90A are bent from side edges 80A and 82A, respectively, with center web 78A optimally being connected to both of the legs 92A and 94A of L-shaped webs 88A and 90A. This arrangement of center web 78A provides increased strength due to the working of the material when forming center web 78A and L-shaped webs 88A and 90A, and is sometimes referred to as a "camelback" bend. Gussets or creases can be added for further strengthening central web 78A and L-shaped webs 88A and 90A. For example, shown is a depressed area or gusset 98A which strengthens center web 78A and a crease 100A which strengthens L-shaped web 88A. Outer leg 94A of each L-shaped web 88A and 90A includes a hole 102A, holes 102A being aligned and adapted to receive a pivot pin to form the axis of rotation of the hinge 20A. Notably, when pivoted fully open, arm flanges 72A and 74A abut outer edge 84A, thus preventing over-travel or over-extension of hinge 20A.

An attachment structure 106A (FIG. 17) is formed on hinge base 22A by bending a triangularly-shaped first tab 108A on inner edge 86A into planar alignment with second and third tabs 110A and 112A extending from the inner edges of inner legs 92A. The tip of first tab 108A includes a recess 114A for matingly receiving teeth 116A and 118A on the inner sides of second and third tabs 110A and 112A, respectively, This allows first tab 108A to effectively capture tabs 110A and 112A, thus assuring that attachment structure 106A is a stable arrangement as bolted to the vehicle 24A. Each tab 108A, 110A and 112A includes a hole 120A for receiving a bolt to retain hinge base 22A to vehicle 24A.

Figure 19:
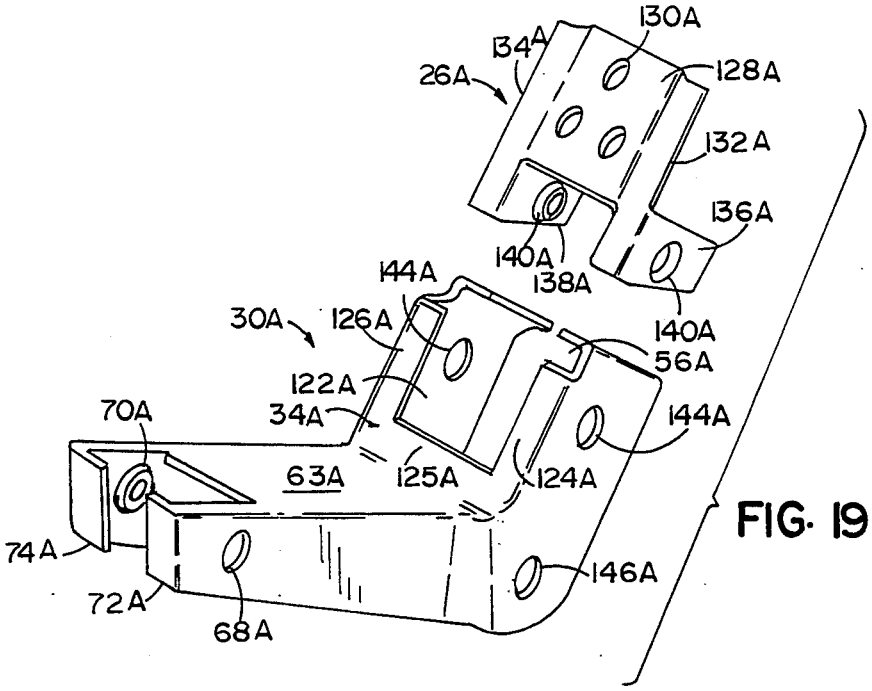
FIG. 19 is a perspective view of the hinge member shown in FIG. 18 but modified for use in a three-piece telescoping hinge arrangement, and also showing a panel bracket.

As thus described, hinge base 22A and hinge member 30A are interconnectable in a two-piece arrangement by positioning a pivot pin (not shown) through aligned holes 102A and holes 68A. However, advantageously, hinge member 30A is configured so that it can be reworked by stamping to form a part 30A' (FIG. 19) for use in a three-piece telescoping hinge, i.e., hinge 20A. Specifically, hinge member 30A' includes an open area around planar section 34A such that the material defining holes 36A can be stamped out to leave an enlarged aperture 122A bounded by flanges 124A, 125A and 126A in planar section 34A. Thus, hinge member 30A is formed into new part 30A' which is adapted to slideably receive panel bracket 26A. Notably, the section of material defining-holes 36A can be readily punched out or cut out even after forming hinge member 30A due to the open design of the part.

Panel bracket 26A (FIG. 19) includes a center segment 128A including holes 130A arranged in a pattern substantially the same as holes 36A in the piece removed from hinge member 30A when forming hinge member 30A'. Center segment 128A is narrow enough to mateably fit within enlarged aperture 122A, and includes opposing wing-like flanges 132A and 134A that extend downwardly from the plane of segment 128A and outwardly and under flanges 124A and 126A on planar section 34A. Notably, wing-like flanges 132A and 134A slip through gap 56A and between side-flanges 44A and 46A, thus acting as a guide for fore-to-aft telescoping movement of panel bracket 26A on hinge member 30A. A pair of ear-like flanges 136A and 138A extend downwardly from the inner ends of wing-like flanges 132A and 134A, and further stabilize this sliding telescoping movement. Ear-like flanges 136A and 138A include inwardly extruded holes 140A which are adapted to receive self-tapping screws. In the fully extended position, holes 140A align with holes 144A inside flanges 44A and 46A, thus securely holding panel bracket 26A in the fully extended position to facilitate painting of adjacent area located on body panel 28A and vehicle 24A (see FIG. 20). In the fully retracted position, holes 140A align with holes 146A to secure panel bracket 26A and body panel 28A in the final assembly position giving body panel 28A optimal fit to vehicle 24A (see FIG. 21). Notably, this arrangement allows pre-alignment of body panel 28A in the bodyshop as sheet metal parts are being fit to vehicle 24A, allows the body panel 28A to be extended for painting without removing the body panel 28A thus reducing damage and on-line handling, and further permits repositioning of body panel 28A adjacent vehicle 24A in the position determined in the bodyshop without a secondary and repetitive realignment operation on the assembly line.

Figure 20:
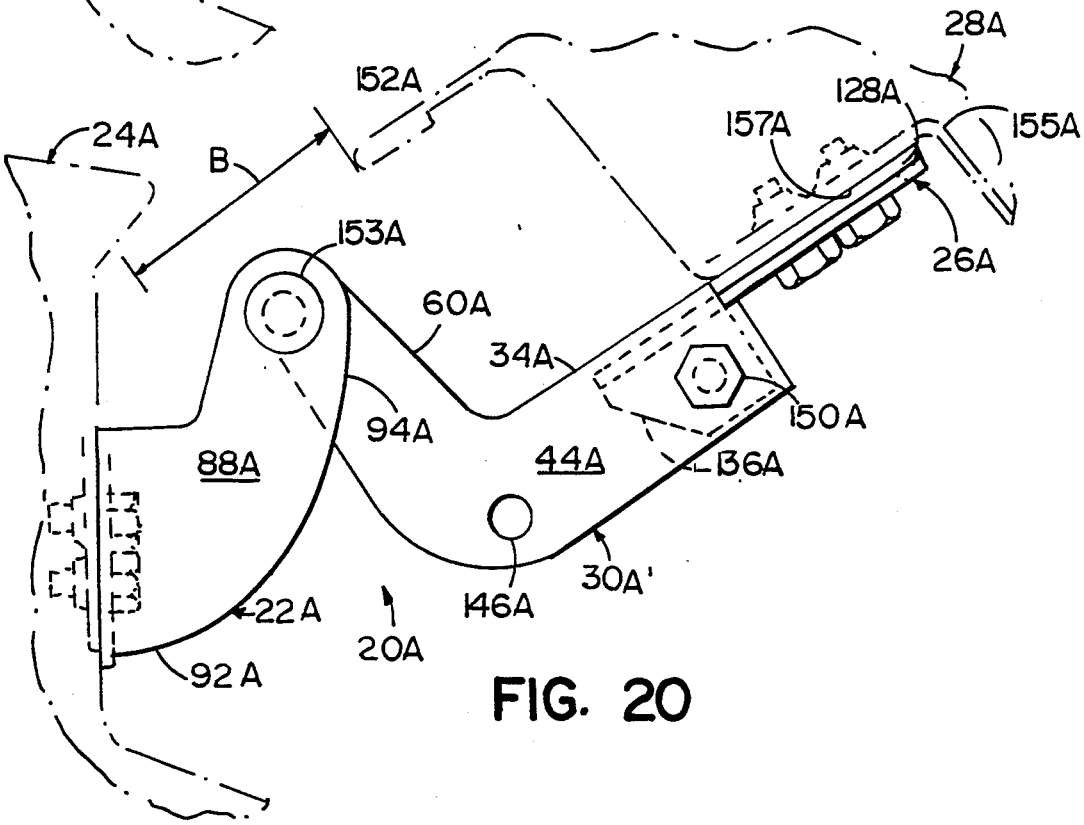
FIG. 20 is a side view of the second hinge assembly, the second hinge assembly being arranged in the three-piece telescoping hinge arrangement with the vehicle panel and the panel bracket being shown in a partially open intermediate and extended position to space the vehicle panel from the vehicle for optimal painting.
Figure 22:
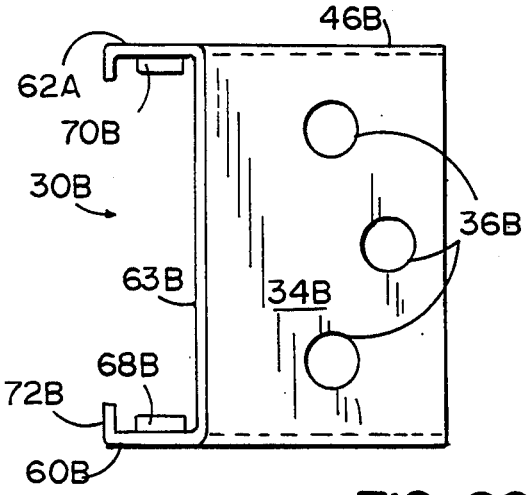
FIGS. 22–24 are orthogonal views of a hinge member for use in a third hinge assembly embodying the present invention, the hinge member being useable in a two-piece hinge arrangement as shown in FIGS. 34–36.
Figure 24:
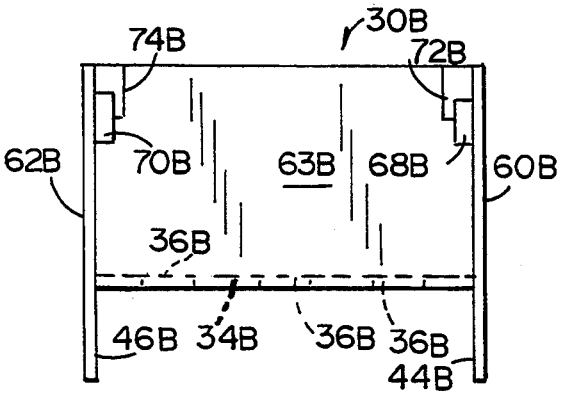
Figure 23:
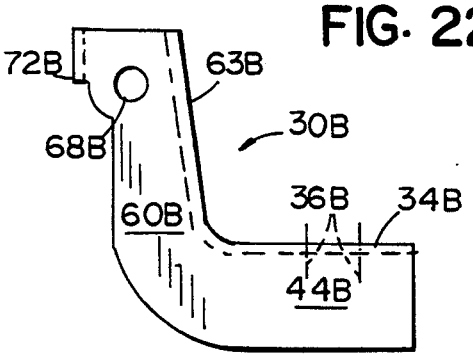

With specific reference to FIG. 20, three-piece hinge 20A is shown as pivoted to an intermediate optimal position for painting. Notably the hinge has been fully extended and a bolt 150A has been extended into each hole 144A and threadingly into hole 140A to secure panel bracket 26A in the fully extended position on hinge member 30A. Also,. a pivot pin 153A connects hinge base 22A and hinge member 30A'. Notably, arrow B illustrates the increased clearance due to the extension of hinge 20A.

Figure 21:
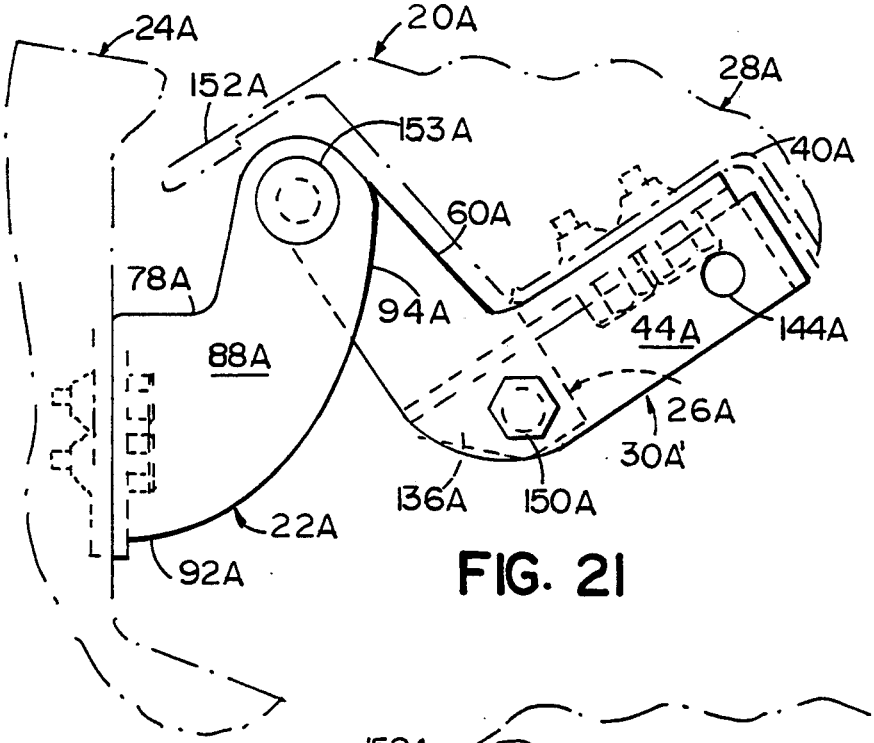
FIG. 21 is a side view comparable to FIG. 20 but with the vehicle panel and the panel bracket in a fully retracted position for final sheet metal fit on final assembly.

In FIG. 21, bolt 150A has been removed, hinge 20A has been retracted so that panel bracket 26A and body panel 28A are positioned adjacent vehicle 24A in the desired position, and bolt 150A has been reinserted in holes 146A, 140A to secure same in the finished position.

THIRD EMBODIMENT

Figure 34:
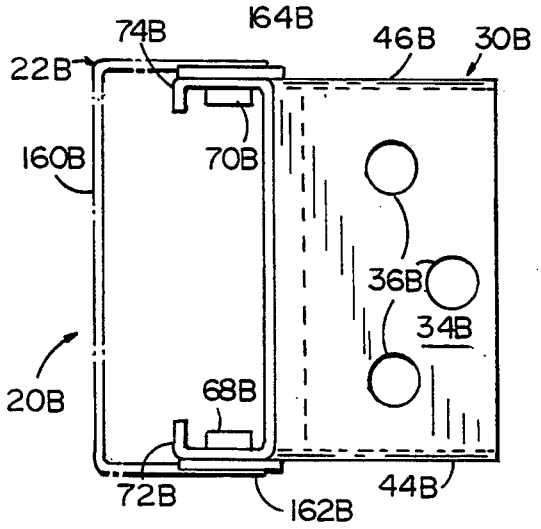
FIGS. 34–36 are orthogonal views of the two-piece-hinge arrangement of the third embodiment, with the hinge base being shown in phantom in FIG. 36.
Figure 36:
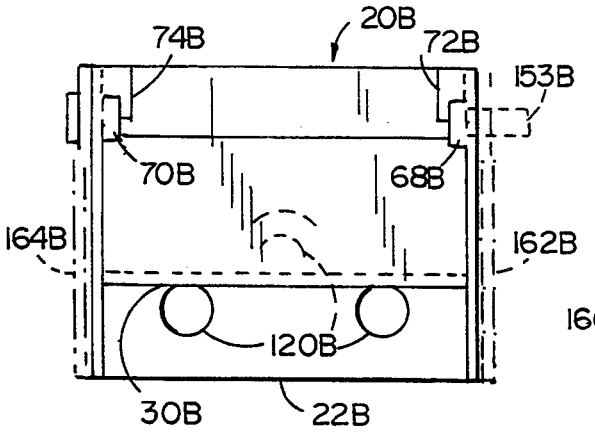
Figure 35:
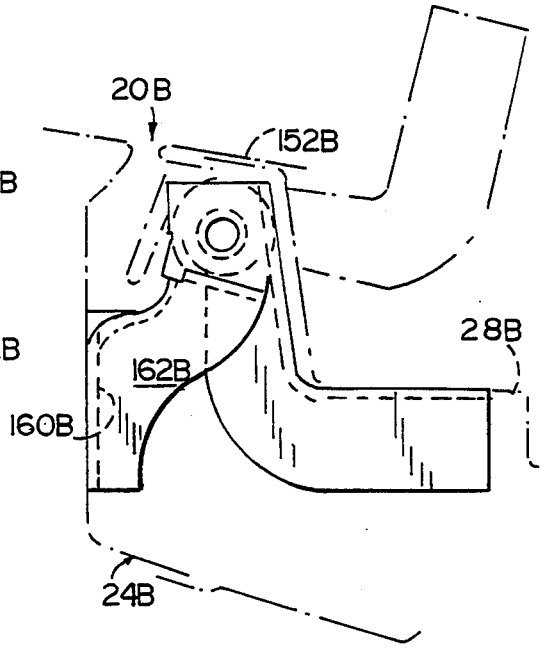

A third hinge 20B embodying the present invention is shown in FIGS. 34–36 as a two-piece hinge arrangement and in FIGS. 37–40 as a three-piece telescoping hinge arrangement 20B'. Several items of hinge 20B are comparable to hinge 20A, at hence cooperating members are identified by using the letter "B" as a suffix instead of the letter "A" to simplify the discussion hereinafter.

As shown in FIGS. 37–40, hinge assembly 20B includes a hinge base 22B adapted to attach to a vehicle 24B, a panel bracket 26B adapted to attach to a vehicle body panel such as a rear gate 28B, and a hinge member 30B' (FIGS. 38 and 40, modified from hinge member 30B) pivotally connected to the hinge base 22B and slideably connected to the panel bracket 26B (FIGS. 37–40). Alternatively, like hinge 20A, hinge 20B may be a two-piece, non-extendable assembly using hinge member 30B (FIGS. 22–24 and 34–36). Notably, hinge 20B offers weight savings and also less waste from scrap material when forming hinge 20B than when forming hinge 20A, and for these reasons may be preferable over hinge 20A.

Hinge member 30B (FIGS. 22–24) is a part stamped from a single sheet of metal, preferably about 13 gauge (0.090 inch) HRPO steel. Hinge member 30B includes an attachment portion formed by a planar section 34B with holes 36B therein for attaching hinge member 30B to an exposed side of body panel 28B. Hinge member 30B further includes spaced flanges 44B and 46B that extend perpendicularly from opposite sides of planar section 34B. A pair of spaced apart arms 60B and 62B interconnected by planar section 63B extend from flanges 44B, 46B and planar section 34B respectively. Members 34B, 44B, 46B, 60B, 62B and 63B form a "camelback" bend as previously described in the second embodiment. Arms 60B and 62B include aligned inwardly extruded holes 68B and 70B. Flanges 72B and 74B extend inwardly from the ends of arms 60B and 62B, flanges 72B and 74B preventing over-travel of hinge 20B. It is noted that flanges 72B and 74B provide a similar function to flanges 72A and 74A in hinge 20A, however flanges 72B and 74B are positioned on a lateral side of arms 60B and 62B instead of on the extreme ends thereof.

Figure 28:
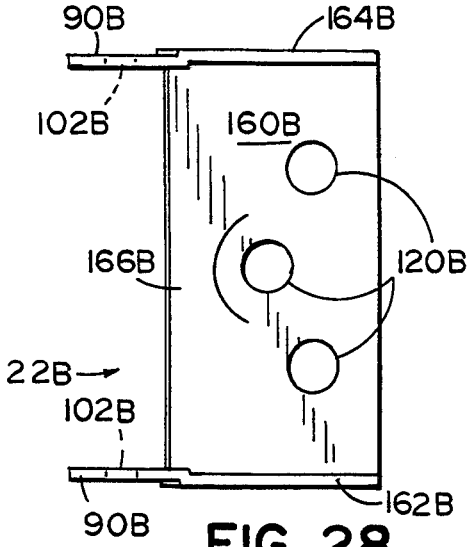
FIGS. 28–30 are orthogonal views of a hinge base for use in the third hinge assembly.
Figure 30:
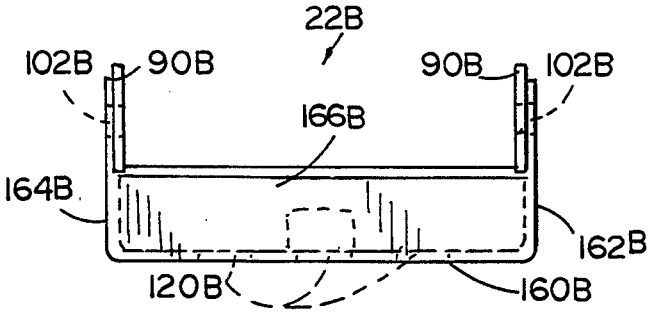
Figure 29:
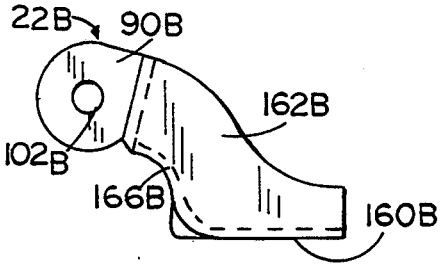

Hinge base 22B (FIGS. 28–30) is also a part stamped from a single sheet of metal preferably about 13 gauge (0.090 inch) HRPO steel. Hinge base 22B includes a one-piece attachment flange 160B, and further includes side flanges 162B and 164B and a central shaped flange 166B, members 160B, 162B, 164B and 166B forming a "camelback" arrangement as previously described. A pair of ear-like flanges 90B and 92B with holes 102B therein extend from the end of side flanges 162B and 164B.

The two-piece hinge arrangement of hinge 20B is shown in FIGS. 34–36, and includes hinge member 30B and hinge base 22B.

Figure 25:
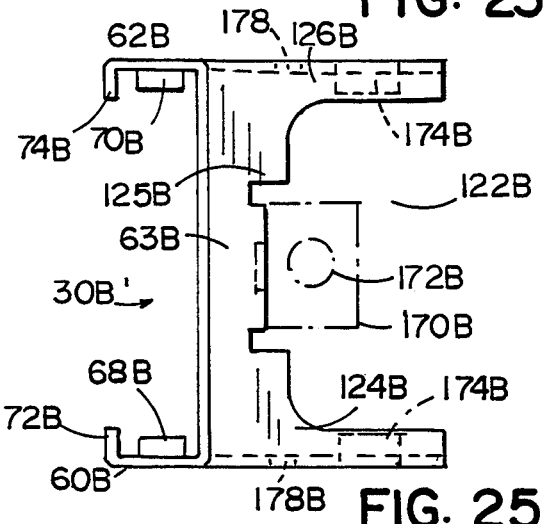
FIGS. 25–27 are orthogonal views of the hinge member shown in FIGS. 22–24 but modified for use in a three-piece telescoping hinge arrangement as shown in FIGS. 37–40.
Figure 27:
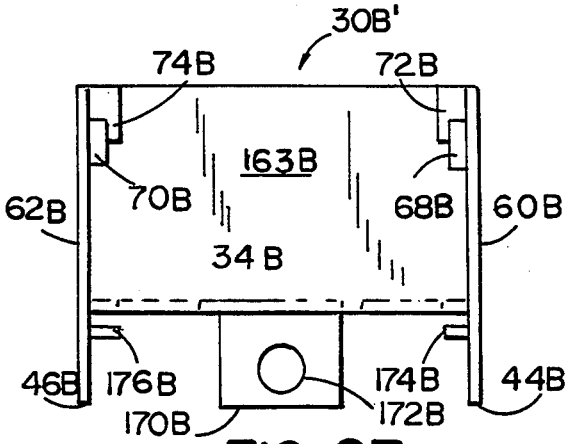
Figure 26:
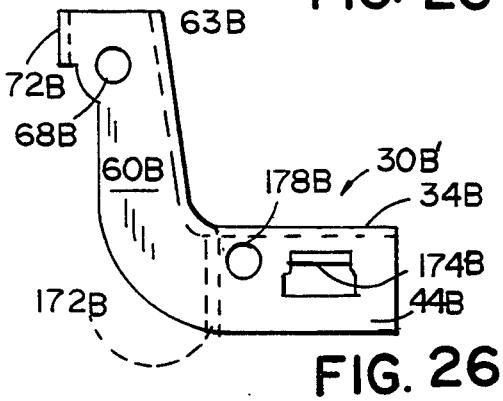

Hinge member 30B can be modified to form hinge member 30B' (FIGS. 25–27) so that hinge 20B can be made into a three-piece hinge arrangement. In particular, hinge member 30B' includes forming aperture 122B in hinge member 30B, but with a centrally located tab 170B not being removed. Tab 170B includes a hole 172B and is shown in phantom in its original stamped condition in FIG. 25, but is bent downwardly perpendicular as shown in all FIGS. 25–27. Aperture 122B is thus defined by flanges 124B, 125B and 126B which extend around three sides of aperture 122B. Also, side tabs 174B and 176B are formed in sides 60B and 62B, and holes 178B are formed immediately behind but spaced from tabs 174B and 176B.

Figure 31:
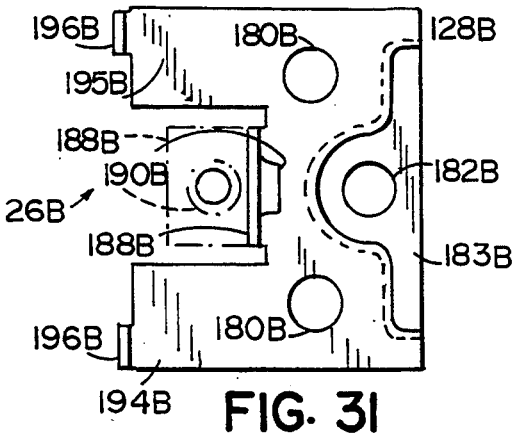
FIGS. 31–33 are orthogonal views of a panel bracket for use in the third hinge assembly.
Figure 33:
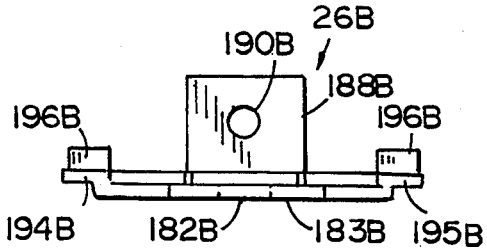
Figure 32:
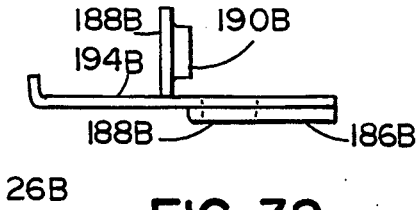
Figure 40:
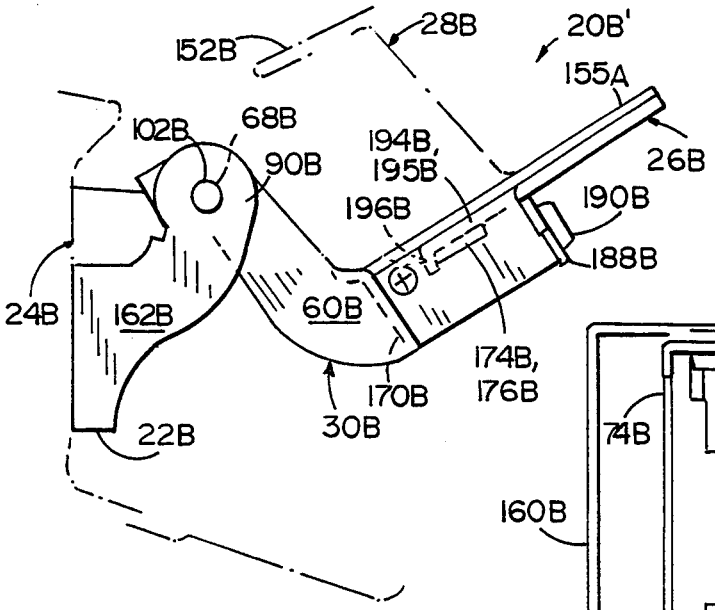
FIG. 40 is a side view of the three-piece telescoping hinge arrangement of the third embodiment, the hinge being in the extended position.
Figure 37:
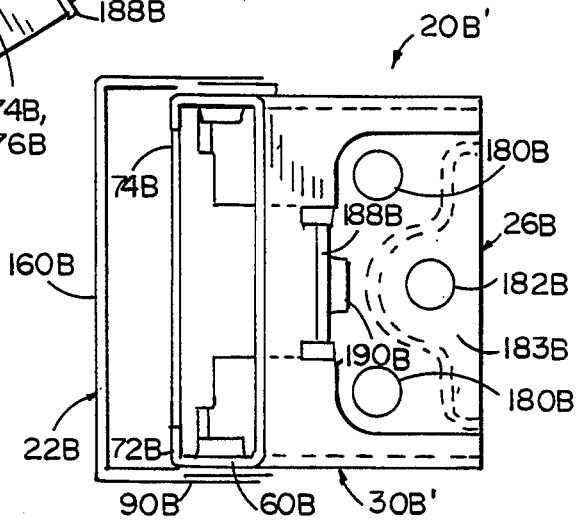
FIGS. 37–39 are orthogonal views of the three-piece telescoping hinge arrangement of the third embodiment, the hinge being in the retracted position and with the hinge base being shown in phantom in FIG. 39.
Figure 39:
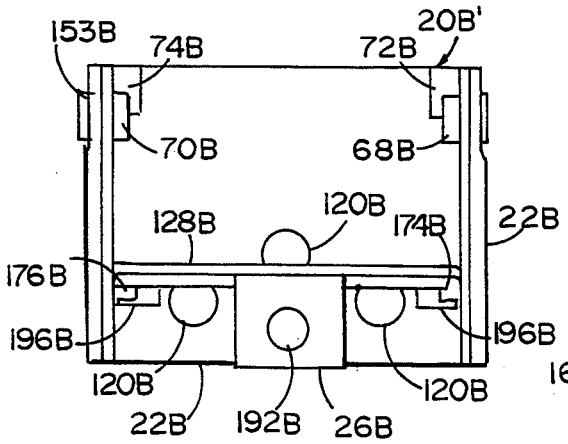
Figure 38:
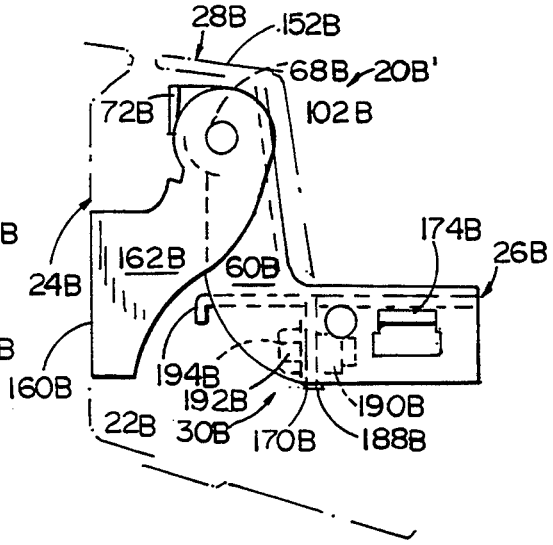

Hinge panel bracket 26B (FIGS. 31–33) is also stamped from sheet metal, preferably about 13 gauge (0.090 inch) HRPO steel, and includes an attachment plate portion 128B with two holes 180B and a single hole 182B stamped therein in a triangular fashion. Holes 180B are extruded. Hole 182B is not extruded, but is located in a depressed area 183B on attachment plate portion 128B such that the lower surface 186B located around hole 182B aligns with the lower end 188B of extruded holes 180B (FIG. 32). A center tab 188B with extruded hole 190B is formed perpendicularly to attachment plate portion 128B. Center tab 188B is adapted to abut tab 170B on hinge member 30B when three-piece hinge 20B is in the fully retracted position (FIG. 38). When fully retracted, holes 190B and 172B align such that a bolt 192B can be secured therein to securely hold panel bracket 26B in the retracted position on hinge member 30B (FIG. 38). Hinge panel bracket 26B further includes arms 194B and 195B which extend rearwardly on either side of center tab 188B, rear arms 194B and 195B including tabs 196B at the outer rear extremity of rear arms 194B and 195B. Tabs 196B are positioned to abut side tabs 174B and 176B on hinge member 30B when hinge panel bracket 26B is extended (FIG. 40). Notably, when extended, side tabs 196B are located between tabs 196B and holes 178B such that a bolt or pin can be placed through holes 178B to trap side tabs 196B and thus hold panel bracket 26B in the extended position. It is contemplated that panel bracket 26B can be held in the extended position merely by sliding a pin into holes 178B, although it is noted that the bolt could be threaded into holes 178B or otherwise more permanently secured therein.

The operation of hinge 20B in either the two-piece hinge arrangement (FIGS. 34–36), and also in the three-piece hinge arrangement (FIGS. 37–40), is otherwise self-explanatory based on the previous discussion and in particular based on the discussion of the second embodiment, hinge 20A.

Thus, three embodiments of hinges are provided that are telescopingly slideable to an extended position for providing increased clearance between an associated body panel and vehicle to facilitate painting or other manufacturing operations without requiring that the body panel be disconnected from the vehicle, the hinges also being telescopingly slideable to a retracted position for providing an acceptably close final assembly fit of the body panel to the vehicle.

In the foregoing description, it will be readily appreciated by those skilled in the art that modifications may be made to the invention without departing from the concepts disclosed herein. Such modifications are to be considered as included in the following claims, unless these claims by their language expressly state otherwise.

The embodiments of the invention in which an exclusive property or privilege is claimed are defined as follows.

1. A hinge for a vehicle comprising:

a hinge base adapted to attach to one of a vehicle panel and a vehicle;

a panel bracket adapted to attach to the other of a vehicle panel and a vehicle;

a hinge member operably connected to said hinge base and said panel bracket, said panel bracket being slideably attached to said hinge member and movable between an extended position and a retracted final assembly position, said hinge member being pivotally connected to said hinge base and being rotatably movable through an arcuate path including a panel open position, a panel closed position and at least one intermediate position therebetween, said panel bracket when in said extended position being movable to the intermediate position in said arcuate path so that the panel is spaced from the vehicle to facilitate painting of the panel and the vehicle, said panel bracket when in said retracted position locating the panel relative to the vehicle as desired, said panel bracket including a first hole and said hinge member including a second hole which align when in said extended position, and said hinge member including a third hole which aligns with said first hole when in said retracted position;

a fastener system for securing said panel bracket to said hinge member in said extended position and in said retracted position, said fastener system for securing including a bolt engageable with first and second holes when aligned, and with said first and third holes when aligned, whereby the panel can be readily extended to facilitate painting and can be retracted for final panel fit during vehicle assembly without removing the panel from the vehicle; and a limiting member on one of said panel bracket and said hinge bracket for limiting the sliding movement of said hinge member on said panel bracket to a predetermined stroke.

2. A hinge as defined in claim 1 wherein said hinge member includes an arm, and said panel bracket forms a sleeve that is telescopingly slideably mounted on said arm for controlled movement between said extended position and said retracted position.

3. A hinge as defined in claim 2 wherein said hinge member is made from sheet metal.

4. A hinge as defined in claim 3 wherein said panel bracket is made from sheet metal.

5. A hinge as defined in claim 1 wherein said limiting member includes a slot on one of said panel bracket and said hinge member, and a slot engaging tab in the other of said panel bracket and said hinge member, said tab engaging the ends of said slot to limit the sliding movement.

6. A hinge as defined in claim 1 wherein said hinge member and panel bracket are made from sheet metal.

7. A hinge as defined in claim 1 including means for limiting the rotational movement of said hinge member on said hinge base.

8. A hinge as defined in claim 7 wherein said means for limiting the rotational movement includes a stop on one of said hinge member and said hinge base, and a stop-engaging tab that abuttingly engages said stop located on the other of said hinge member and said hinge base.

9. A hinge arrangement as defined in claim 1 wherein said hinge base, said panel bracket, and said hinge member are stamped parts.

10. A hinge as defined in claim 1 wherein one of said first, second and third holes is defined by extruded material for securely receiving a self-tapping screw.

11. A hinge for a vehicle comprising:

a hinge base adapted to attach to one of a vehicle panel and a vehicle;

a panel bracket adapted to attach to the other of a vehicle panel and a vehicle;

a hinge member operably connected to said hinge base and said panel bracket, said panel bracket being slideably attached to said hinge member and movable between an extended position and a retracted final assembly position, said hinge member being pivotally connected to said hinge base and being rotatably movable through an arcuate path including a panel open position, a panel closed position and at least one intermediate position therebetween, said panel bracket when in said extended position being movable to the intermediate position in said arcuate path so that the panel is spaced from the vehicle to facilitate painting of the panel and the vehicle, said panel bracket when in said retracted position locating the panel relative to the vehicle as desired, said panel bracket including a first hole and said hinge member including a second hole that align when in said extended position, and said hinge member including a third hole that aligns with said first hole when in said retracted position;

means for securing said panel bracket to said hinge member in said extended position and in said retracted position, said means for securing including a bolt engageable with first and second holes when aligned, and with said first and third holes when aligned, whereby the panel can be readily extended to facilitate painting and can be retracted for final panel fit during vehicle assembly without removing the panel from the vehicle;

one of said panel bracket and said hinge member defining a rectangular elongate pocket with an open end, and the other of said panel bracket and said hinge member defining a rectangular elongate arm for slideably engaging said pocket, whereby said panel bracket is controllably extendable and retractable without fear of dropping and damaging the panel;

said hinge member including extruded material defining an extruded hole for securely frictionally receiving a screw without the need for separate fasteners, said panel bracket including a second hole alignable with and positionable adjacent said extruded hole when said hinge member is in said retracted position; and a screw engaging said extruded hole and said second hole to hold said hinge member in said retracted position on said panel bracket.

12. A hinge as defined in claim 11 wherein said screw is a self-tapping screw.

13. An adjustable hinge for an article having a stationary member and a movable member, comprising:

a first hinge member adapted to mount to a stationary member;

a second hinge member pivotally attached to said first hinge member for rotation between various positions including a manufacturing facilitating position; and a third member adapted to mount to a movable member, said third member being slideably mounted to said second hinge member for movement along a predetermined stroke between an extended position and a retracted position, said third member when in said extended position being adapted to provide clearance between the movable member and the stationary member with said second hinge member being in the manufacturing facilitating position, but said third member when in said retracted position being adapted to provide an acceptable fit between the movable member and the stationary member;

one of said third member and said second hinge member defining a rectangular elongate pocket with an open end, and the other of said third member and said second hinge member defining a rectangular elongate arm for slideably engaging said pocket, whereby said third member is controllably extendable and retractable without fear of dropping and damaging the panel;

said third member including extruded material defining an extruded hole for securely frictionally receiving a screw without the need for separate fasteners, said second member including a second hole alignable with and positionable adjacent said extruded hole when said third member is in said retracted position; and a screw engaging said extruded hole and said second hole to hold said third member in said retracted position on said second member.

14. A hinge as defined in claim 13 wherein said third member forms a sleeve and said second hinge member includes an arm telescopingly slideably mounted in said sleeve for controlled movement between said extended position and said retracted position.

15. A hinge as defined in claim 14 wherein said second hinge member includes means for limiting the sliding movement of said second hinge member on said third member to a predetermined stroke.

16. A hinge as defined in claim 15 wherein said second hinge member is made from sheet metal.

17. A hinge as defined in claim 16 wherein said third member is made from sheet metal.

18. A hinge as defined in claim 13 including means for limiting the sliding movement of said second hinge member on said third member to a predetermined stroke.

19. A hinge as defined in claim 13 including a slot on one of said third member and said second hinge member, and a slot-engaging tab in the other of said third member and said second hinge member, said tab engaging the ends of said slot to limit the sliding movement.

20. A hinge as defined in claim 13 wherein said second hinge member and third member are made from sheet metal.

21. A hinge as defined in claim 13 including means for limiting the rotational movement of said second hinge member on said first hinge member.

22. A hinge as defined in claim 21 wherein said means for limiting the rotational movement includes a stop on one of said second hinge member and said first hinge member, and a tab that abuttingly engages said stop located on the other of said second hinge member and said first hinge member.

23. A hinge arrangement as defined in claim 13 wherein said first hinge member, said second hinge member, and said third member are stamped parts.

24. A hinge as defined in claim 13 wherein said screw is a self-tapping screw.

25. A hinge for a vehicle comprising:

a stationary hinge base made of sheet metal including a first portion adapted to be mounted to a vehicle and a pair of flanges including apertures defining an axis of rotation;

a panel bracket including a second portion adapted to attach to a vehicle panel and including a rectangular elongate sleeve with a slot therein extending parallel to the sleeve and an aperture therein opposite the slot;

a hinge member including an arm, said panel bracket being slideably mounted on said arm and movable between an extended position and a retracted final assembly position, said arm including a first and second hole aligned with said slot, said first and second holes being spaced apart and separately alignable with said aperture, said hinge member also including a second portion with a transverse hole therein, said transverse hole being alignable with said flange apertures for receiving a pivot pin to pivotally connect said hinge member to said hinge base, said hinge member being rotatably movable through an arcuate path including a panel open position, a panel closed position and at least one intermediate position therebetween, said hinge member when said panel bracket is in said extended position being movable to the intermediate position in said arcuate path so that the panel is spaced from the vehicle to facilitate painting of the panel and the vehicle, said hinge member when said panel bracket is in said retracted position locating the panel relative to the vehicle as desired; and means for securing said panel bracket to said hinge member in said extended position and in said retracted position, said means for securing including a screw extendable through said slot, a selected one of said first and second holes, and said aperture, whereby the panel can be readily controllably extended to facilitate painting and can be readily controllably retracted for final panel fit during vehicle assembly without removing the panel from the vehicle and without fear of dropping and damaging the panel.

* * * * *

UNITED STATES PATENT AND TRADEMARK OFFICE

CERTIFICATE OF CORRECTION

PATENT NO. : 5,361,455

DATED : November 8, 1994

INVENTOR(S) : James (NMI) Kiefer

It is certified that error appears in the above-indentified patent and that said Letters Patent is hereby corrected as shown below:

Column 7, line 29;
"webs 8A" should be —webs 88A—.

Signed and Sealed this

Eighteenth Day of July, 1995

Bruce Lehman

*Attest:*

BRUCE LEHMAN

*Attesting Officer*

*Commissioner of Patents and Trademarks*